US006473747B1

(12) United States Patent
Biggers et al.

(10) Patent No.: US 6,473,747 B1
(45) Date of Patent: Oct. 29, 2002

(54) NEURAL NETWORK TRAJECTORY COMMAND CONTROLLER

(75) Inventors: James E. Biggers, Corona, CA (US); Kevin P. Finn, Tucson, AZ (US); Homer H. Schwartz, II, Oro Valley, AZ (US); Richard A. McClain, Jr., Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/004,947

(22) Filed: Jan. 9, 1998

(51) Int. Cl.[7] ..... G06N 3/02

(52) U.S. Cl. ..... 706/24; 706/21; 706/23; 706/3

(58) Field of Search ..... 704/1; 701/4; 706/3, 706/24, 23, 21

(56) References Cited

U.S. PATENT DOCUMENTS 5,631,830 A * 5/1997 Schroeder ..... 701/4
5,835,869 A * 11/1998 Schroeder ..... 701/4

FOREIGN PATENT DOCUMENTS

DE 42 18 600 12/1993
DE 196 45 556 10/1997

OTHER PUBLICATIONS

Garcia, Randy E. et al, Memory Neural Network Algorithm for Missile Control, Proceedings of the 37th Midwest Symposium on Circuits and Systems, part 1 of 2, IEEE, pp. 634–636, Aug. 3–5, 1994.*

Eichblatt, Emil J., Test and Evaluation of the Tactical Missile, vol. 119, Progress in Astronautics and Aeronautics, Jan. 1989, pp. 53, Fig. 43; pp. 71, table 7.*

Phillips, Charles L., Digital Control System Analysis and Design, Prentice–Hall, Inc., Jan. 1984, pp. 306–327.*

Steck, James E., et al., Use of Hopfield Neural Networks in Optimal Guidance, IEEE Transactions on Aerospace and Electronic Systems vol. 30, No. 1, pp. 287–293, Jan. 1994.*

Garcia, Randy E. et al, Memory Neural Network Algorithm for Missile Control, Proceedings of the 37th Midwest Symposium on Circuits and Systems, Part 1 of 2, IEEE, PP. 634–636, Aug. 3–5, 1994.*

Steck, James E., et al. Use of Hopfield Neural Networks in Optimal Guidance, IEEE Transactions on Aerospace and Electronic Systems, vol. 30, No. 1, pp. 287–293, Jan. 1994.*

Han, Dongchen et al. Adaptive critic Based Neural Networks for Control–Constrained Agile Missile Control, Proceesinds of the American Control Conference, pp. 2600–2604, Jun. 1999.*

(List continued on next page.)

*Primary Examiner*—Mark R. Powell
*Assistant Examiner*—Wilbert Starks
(74) *Attorney, Agent, or Firm*—Colin M. Raufer; David W. Collins; Glenn H. Lenzen, Jr.

(57) ABSTRACT

An apparatus and method for controlling trajectory of an object (47) to a first predetermined position. The apparatus has an input layer (22) having nodes (22*a*-22*f*) for receiving input data indicative of the first predetermined position. First weighted connections (28) are connected to the nodes of the input layer (22). Each of the first weighted connections (28) have a coefficient for weighting the input data. An output layer (26) having nodes (26*a*-26*e*) connected to the first weighted connections (28) determines trajectory data based upon the first weighted input data. The trajectory of the object is controlled based upon the determined trajectory data.

10 Claims, 4 Drawing Sheets

OTHER PUBLICATIONS

Widrow, Bernard et al, Layered Neural Nets for Pattern Recognition, IEEE Transactions on Acoustics, Speech, and Signal Processing, vol. 36, No. 7, pp. 1109–1118, Jul. 1988.*
Geiger, Kevin et al, Intelligent Mission Adaptive Controller (IMAC), Aerospace and Electronics Conference, 1989. NAECON 1989., Proceedings of the IEEE 1989 National , Jan. 1989, pp.: 1185–1192 vol. 3.*
Creaser, P.A., Generation of missile guidance algorithms, Optimisation in Control: Methods and Applications (Ref. No. 1998/521), IEE Colloquium on , Jan. 1998, pp.: 7/1–7/3.*
Nguyen, D.H.; Widrow, B., Neural networks for self–learning control systems, IEEE Control Systems Magazine vol.: 103 , Apr. 1990, pp.: 18–23.*
Saini, G.; Balakrishnan, S.N., Adaptive critic based neurocontroller for autolanding of aircrafts, American Control Conference, 1997. Proceedings of the 1997 vol.: 2, Jan. 1997, pp.: 1081–1085 vol. 2.*
Mickle, M.C.; Zhu, J.J., Nonliner missile planar autopilot design based on PD–spectrum assignment, Decision and Control, 1997., Proceedings of the 36th IEEE Conference on vol.: 4, Jan. 1997, pp.: 3914–3919 vol. 4.*

* cited by examiner

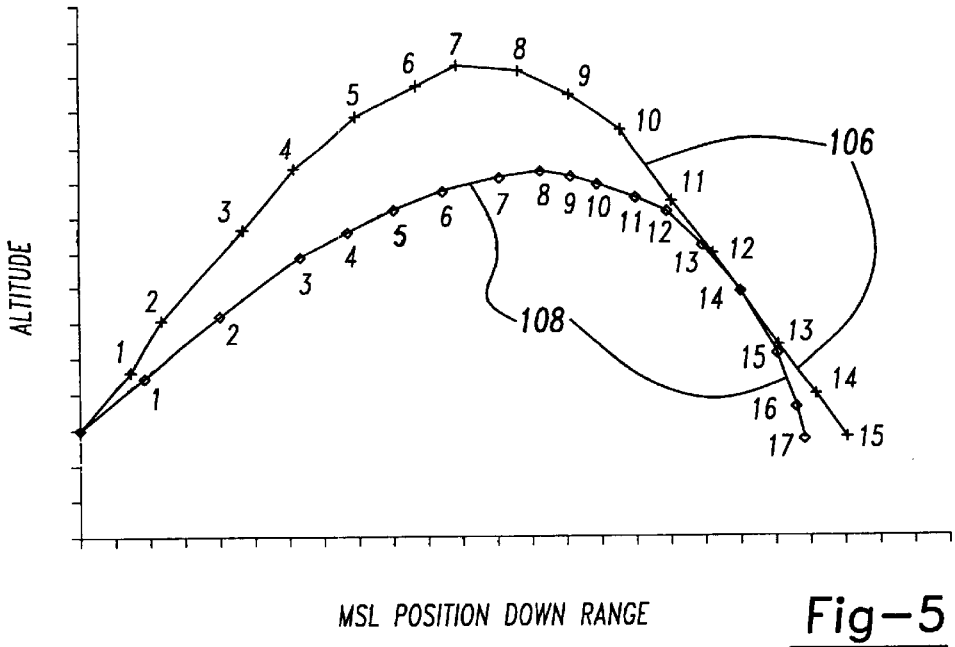
Fig-5
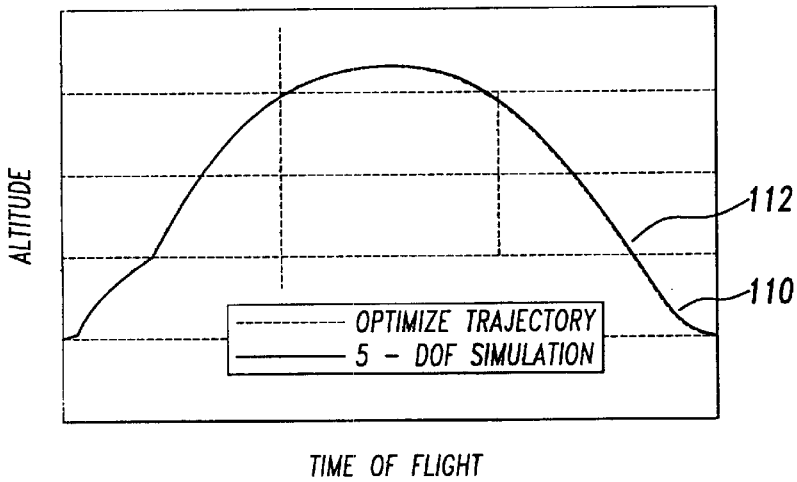
Fig-6A
Fig-6B
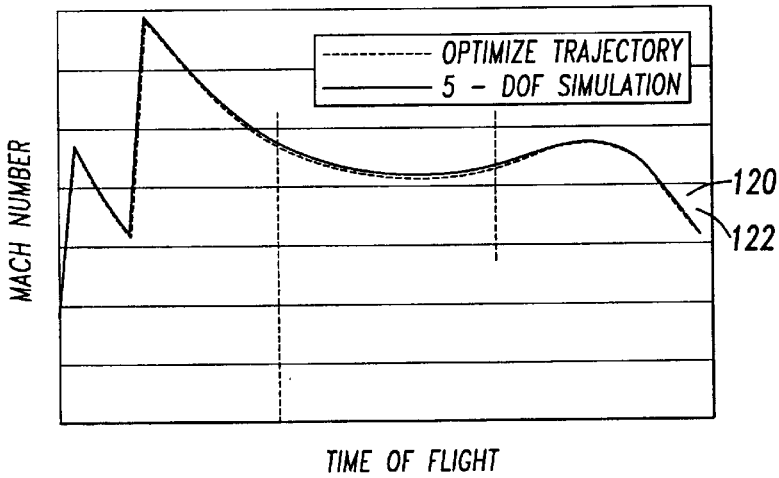

NEURAL NETWORK TRAJECTORY COMMAND CONTROLLER

BACKGROUND OF THE INVENTION

1. Field of the Invention

The present invention relates generally to trajectory control of objects, and more particularly, to neural networks used in trajectory control of objects.

2. Description of Related Art

There is typically a desire to improve the performance of a missile by increasing its speed, range, and maneuverability without violating physical or functional constraints placed on the system design. Extensive past studies aimed at optimizing all aspects of a missile's trajectory commands for a specific scenario have been of limited value. The situation has been complicated by a desire to optimize performance in multiple scenarios (e.g., a desire for a missile to take the quickest path to its target and minimize "miss distance" at intercept, all the while meeting minimum flight control/maneuverability requirements). In some situations, multiple goals such as these can appear contradictory to the analyst, and often have defied the definition of a theoretically optimum solution, especially, for the case of a maneuvering/evasive target, where the missile must adaptively and continuously arrive at optimum solutions after launch and during missile flight.

Another problem in the implementation of optimized trajectory shaping in guided missiles has involved the immense scale of the problem. The numerous variables involved in the characterization of a specific tactical scenario (e.g., launcher and target locations, velocities and postlaunch maneuvers) contribute to enormously complex physical relationships, which are further complicated by varying uncertainties in associated measurements of these factors.

Previous approaches to tactical decision making in guided missile design have typically taken one of two courses: 1) simplification of the problem to a select (and fixed) set of possible trajectory shaping "schedules" based on roughly-defined input criteria; or 2) an attempt to simulate possible outcomes of different trajectory decisions in "real-time" using on-board missile processing equipment, with the best performing flight path(s) selected from all of the simulation runs conducted. Prior studies have shown that there are significant drawbacks to each of these approaches.

The first approach, for example, while realizable in a constrained guided missile electronics package, produces less-than-optimal performance in many application scenarios. Such simplification of a problem known to have multidimensional relationships and complexities is, effectively, a compromise, and, as such, any goal of optimized performance in widely varying scenarios will also be compromised in its use. This approach reduces complex (and sometimes little-understood) physical phenomena into simplified "on-the-average" equations or "look up" tables in a missile's software or hardware control devices, from which simple interpolation techniques are employed. This, in turn, has resulted in compromised performance in many of the infinite number of mission scenarios possible for such missiles. Nonetheless, this approach has typically been employed in existing guided missiles, with the hope that sufficient testing and analyses can be conducted to identify where significant shortfalls in performance may exist.

Use of the second approach mentioned (i.e., on-board simulation and iterative optimization for the specific launch scenario in which the missile is used) has been effectively prohibited by incapacity of on-board data processing equipment and the tight time frame in which tactical decisions are required. High fidelity simulation of complex in-flight guided missile dynamics taxes even highly-powered ground-based laboratory computer systems. Such missile simulation runs often require a comparable time to execute to that involved in actual missile flight. Therefore, even if on-board tactical data processing equipment was comparable in speed and memory capacity to that typically used in laboratory simulations (which it typically is not), simulation of even one possible outcome would require the entirety of a missile's flight to execute. Clearly, sequential simulations are very difficult to reveal an optimal solution in "real-time".

There is, therefore, a need for a missile to have improved performance obtainable through continually adapted maneuvering controls as appropriate for optimal achievement of multiple kinematic performance objectives specific to each tactical situation.

SUMMARY OF THE INVENTION

In accordance with the teachings of the present invention, an apparatus and method are provided for controlling trajectory of an object to a first predetermined position. The apparatus has an input layer having nodes for receiving input data indicative of the first predetermined position. First weighted connections are connected to the nodes of the input layer. Each of the first weighted connections have a coefficient for weighting the input data. An output layer having nodes connected to the first weighted connections determines trajectory data based upon the first weighted input data. The trajectory of the object is controlled based upon the determined trajectory data.

Additional advantages and aspects of the present invention will become apparent from the subsequent description and the appended claims, taken in conjunction with the accompanying drawings in which:

BRIEF DESCRIPTION OF THE DRAWINGS

FIG. 5 is an x–y graph depicting the altitude versus missile position down range relationship for the present invention and for a conventional trajectory shaping approach;

FIGS. 6*a*–6*b* are x–y graphs depicting performance verifications for the present invention being embodied in an optimized trajectory simulation model and a five degree of freedom simulation model.

DESCRIPTION OF THE PREFERRED EMBODIMENTS

Figure 1:
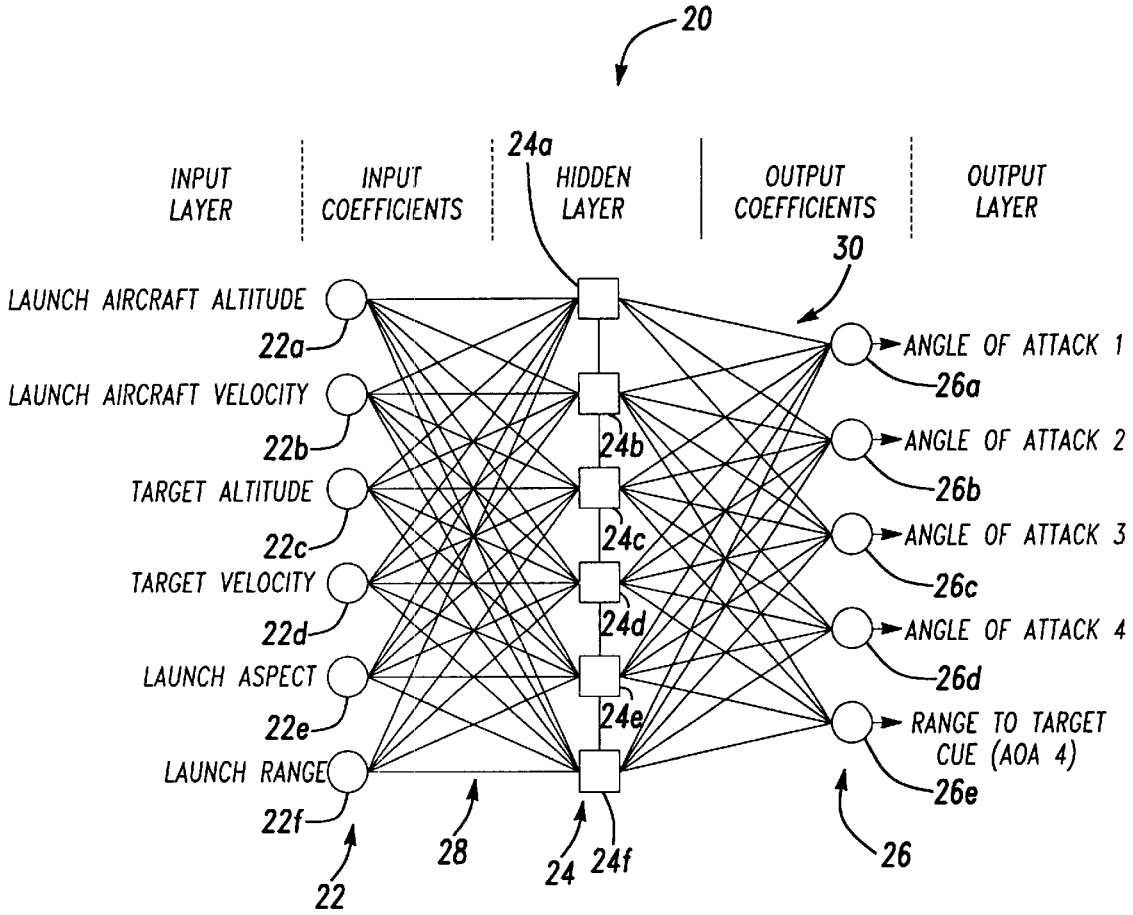
FIG. 1 is an exemplary neural network topological diagram depicting determination of trajectory parameters in accordance with the present invention.

FIG. 1 shows a neural network 20 which controls the trajectory for a missile system. For this example, neural network 20 has the following configuration which was optimized for minimum time of flight of the missile. Neural network 20 has an input layer 22, a hidden layer 24 and an output layer 26. The input layer 22 was six inputs (22*a*–22*f*). The hidden layer 24 has six nodes (24*a*–24*f*). The output layer 26 has five outputs (26*a*–26*e*).

The first two inputs (22*a* and 22*b*) are missile/launch aircraft initial conditions: launch aircraft altitude and velocity. The remaining four inputs (22*c*–22*f*) are target observables at launch: target altitude and velocity; target range; and launch aspect. The outputs (26*a*–26*e*) are: the angles of attack the missile would take during flight; and the target range output which is the missile-to-target range cue to initiate the last angle of attack. The initiation times for the first three angles of attack are predetermined by other missile design factors in this exemplary depiction of the present invention. Weights 28 representing input coefficients connect input layer 22 with hidden layer 24. Weights 30 representing output coefficients connect hidden layer 24 with output layer 26.

While this example shows outputs being angles of attack and a range cue, it should be understood that the present invention is not limited to only these controller outputs. For example, the controller outputs may include such other outputs as commanded G levels wherein commanded G levels are missile directional indicative commands. Additionally, the present invention could control other missile functions as desired. The configuration of the present invention is highly adaptable to existing missile designs.

In this example, neural network 20 preferably uses the following equation in its operations:

$$Optimum\ Output_k = \sum_j \beta_{kj}\, g\left(\theta_j + \sum_i \gamma_{ij}\chi_i\right)$$

where, $$g(u)=1/(1+\exp(-u))$$

Neural network 20 weights the inputs of input layer 22 ($\chi$) by use of weights 28 (i.e., input layer coefficients $\gamma$) and feeds the sums of all weighted products into each node of hidden layer 24, where the sum of the weighted terms is offset by a bias, e. The offset sum of the weighted terms is operated by the nonlinear squashing function, g(u), which in this case is a logistics function.

The response of each node in the hidden layer 24 is the output of the nonlinear squashing function. The hidden node outputs are weighted by weights 30 (i.e., output layer coefficients, $\beta$). The weighted terms from each node of hidden layer 24 are summed to produce the outputs, 1 to k, in the output layer 26 which in this case, are the optimum angle of attacks and range to target for last angle of attack. The present invention also includes using two or more hidden layers to produce trajectory outputs. Moreover, the values of the weighted coefficients vary with respect to the objectives which the missile is to achieve. For example, the objective of the missile may be to economize fuel consumption since the target is at a great distance from the launch site; or the objective may be to reach the target most quickly; or the objective may be maximum missile G's at intercept time which allows the missile to maneuver very quickly; or it may be combinations thereof. The neural network of the present invention preferably stores in a lookup table the different values for its weighted coefficients depending on the objectives.

Neural network 20 can exist in three embodiments which range in degrees of sophistication: "nonadaptive", "adaptive", and "adaptive with anticipation".

Figure 2:
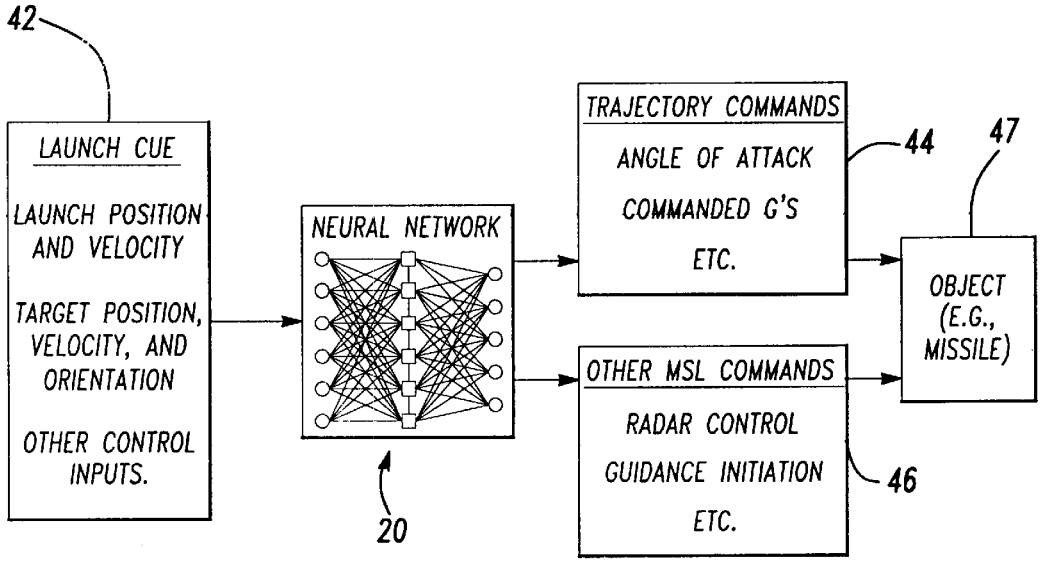
FIG. 2 is a data flow diagram showing the flow of data for a "nonadaptive" neural network.

FIG. 2 shows the first embodiment of the present invention. The "nonadaptive" neural network 20 is provided with an initial launch cue and determines at that time the course to "fly" and guides the missile 47 to that predetermined optimum point in space where the missile guidance system can take control and guide the missile 47 to intercept. Generation of the required training cases is relatively simpler, and neural network training is shorter for the "nonadaptive" neural network 20.

Figure 3:
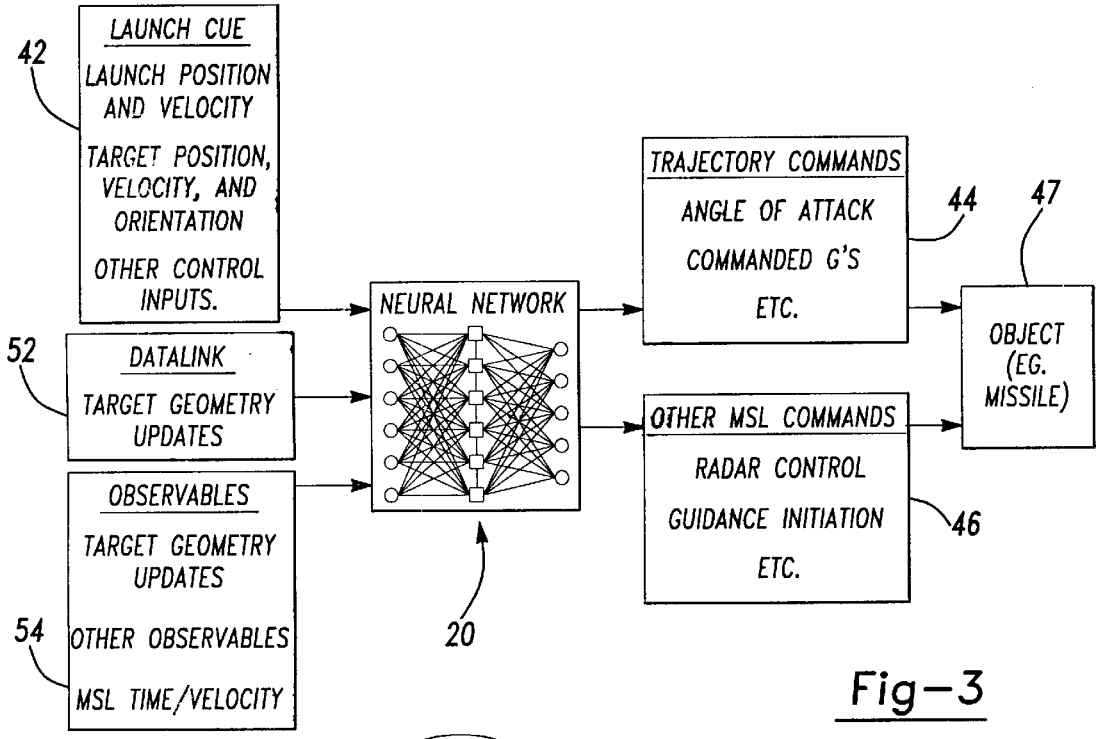
FIG. 3 is a data flow diagram showing the flow of data for an "adaptive" and "adaptive with anticipation" neural network.

Referring to FIG. 3, the "adaptive" neural network 20 uses the launch cue 42, datalink updates 52, and missile observables 54 to command the missile 47 to the optimum point in space where the missile guidance system can take control and guide the missile 47 to intercept. The neural network 20 is "adaptive" in this embodiment since, continuously during flight, the "adaptive" neural network 20 will react to changes in target conditions/maneuvers thereby continuously flying the optimum trajectory.

The data link updates 52 are real-time data updates from such sources as an aircraft or ship and may include the following type of data indicative-of target geometry data: position and velocity of the target. Likewise, the missile observables 54 are real-time data from sensors onboard the missile (e.g., radar) and include the following types of data: target position and velocity, and the missile position and velocity and missile time (i.e., time elapsed since the missile has left the launch craft).

The neural network 20 with "adaptive with anticipation" functionality uses the initial launch cue 42, datalink updates 52, and missile observables 54. It continuously during flight not only reacts to changes in target conditions/maneuvers as with the "adaptive" embodiment but also "anticipates" additional target conditions/maneuvers and directs the missile to a point in space where the missile guidance system can take control and guide the missile to intercept whether or not the target performs the anticipated maneuver.

Training for the embodiments of the present invention includes iteratively providing known inputs with desired outputs. At the end of each iteration, the errors of the outputs are examined to determine how the weights of the neural network are to be adjusted in order to more correctly produce the desired outputs. The neural network is considered trained when the outputs are within a set error tolerance.

The "adaptive with anticipation" embodiment uses different training data than the "non-adaptive" or "adaptive" embodiments. However, the "adaptive with anticipation" uses a similar neural network topology as the "adaptive" embodiment. Generation of the required training cases for the "adaptive with anticipation" embodiment involves incorporating knowledge into the coefficients (i.e., weights) about target maneuverability as a function of target position and velocity.

Figure 4:
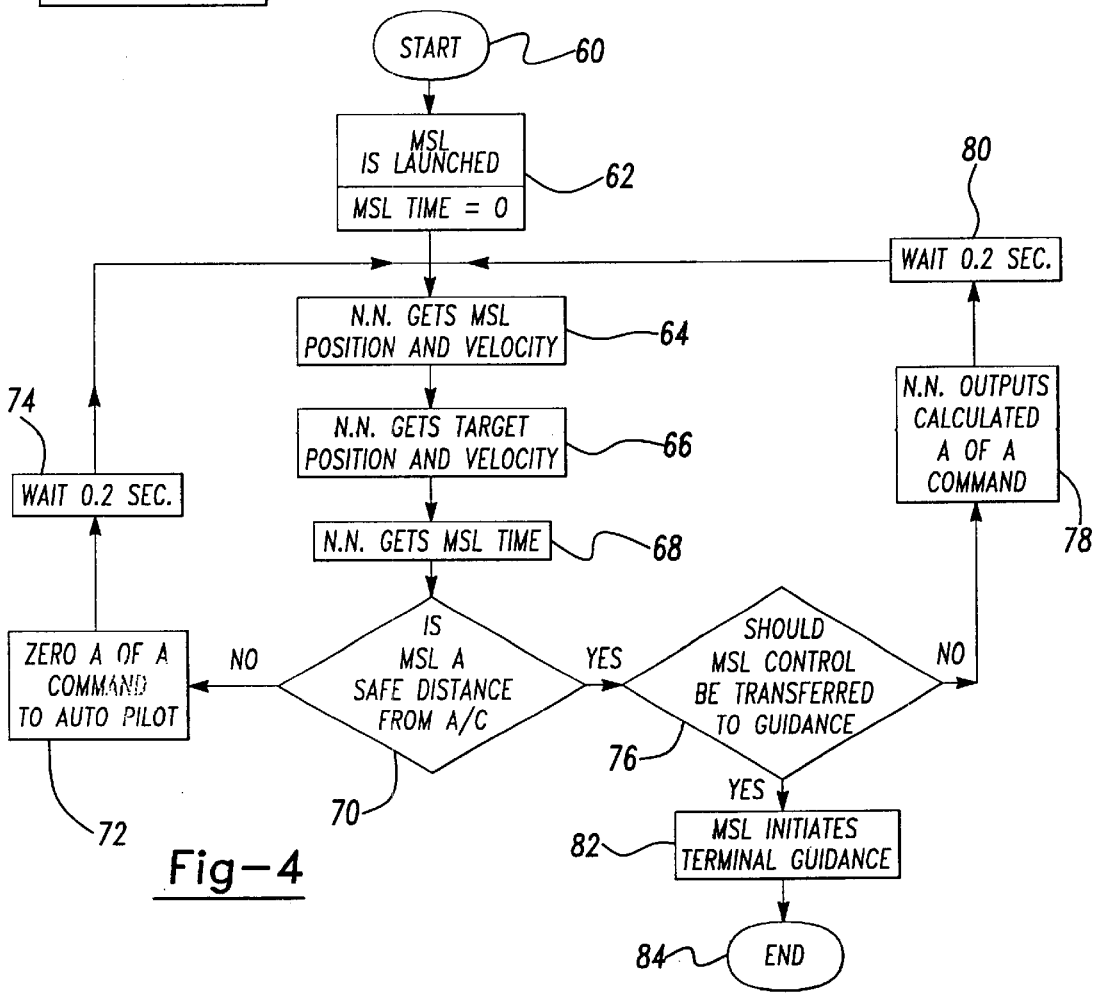
FIG. 4 is a flowchart depicting the sequence of operations involving the neural network of the present invention.

FIG. 4 is a flowchart depicting the operations of the present invention. Start block 60 indicates that block 62 is to be executed first. Block 62 indicates that a missile has been launched and that the missile time is set at zero seconds. The position of the missile at time zero is that of the launch craft.

At block 64, the neural network obtains the missile position and velocity, and at block 66 the neural network obtains the target position and velocity. Block 68 obtains the current missile time which is the time that has elapsed since the missile has been launched.

Decision block 70 inquires whether the missile is a safe distance from the aircraft. If it is not a safe distance, then block 72 is processed wherein a zero angle of attack command is sent to the auto pilot system of the missile, and subsequently block 74 is executed wherein the neural network waits a predetermined amount of time (e.g., 0.2 seconds) before executing block 64.

If decision block 70 determines that the missile is a safe distance from the aircraft, then decision block 76 is processed. If decision block 76 determines that the missile control should not be transferred to the guidance system, then the neural network outputs the calculated angle of attack command at block 78, and the neural network waits a predetermined amount of time (e.g., 0.2 seconds) at block 80 before executing block 64.

However, if decision block 76 does determine that the missile control should be transferred to the guidance system, then the missile initiates the terminal guidance mode at block 82. Processing with respect to this aspect of the present invention terminates at end block 84.

EXAMPLE

A missile neural network controlled model was constructed to predefined kinematic specifications. The output of the "nonadaptive" embodiment was analyzed to determine whether the output trajectory data yielded better results over conventional trajectory-shaping approaches.

FIG. 5 is a graph with an abscissa axis of missile position down range whose units are distance units (e.g., meters). The ordinate axis is the altitude of the missile whose units are distance units (e.g., meters). Curve 106 represents the trajectory of the missile under control of the nonadaptive neural network. Curve 108 represents the trajectory of the missile under a conventional trajectory shaping approach.

The numbers on each curve represent time divisions. A number on one curve corresponds to the same time on the other curve. The line length between two time divisions on the same curve is proportional to the average velocity of the missile.

The results show that the missile with the neural network controller of the present invention performed vastly superior to the conventional approach. For example, the missile at the 15th time division on curve 106 was at a further distance than the missile at the 15th time division on curve 108. In fact, the missile using the conventional trajectory shaping approach did not reach by the 17th time division on curve 108 the same distance as the missile using the approach of the present invention at the 15th time division on curve 106.

Moreover, the performance of the neural network controlled missile model of the present invention was validated by using the neural network outputs in a sophisticated and computationally intensive 5-Degree of Freedom simulation program.

FIG. 6*a* shows the trajectory results 110 using the "nonadaptive" neural network embodiment in the development missile model and the trajectory results 112 using the sophisticated and computationally intensive 5-Degree of Freedom missile simulation program for missile altitude with respect to time.

FIG. 6*b* shows the results 120 of the developmental missile model and results 122 of the 5-degree of freedom simulation program for missile mach with respect to time. As depicted in FIGS. 6*a* and 6*b*, the performance of the developmental missile model agrees quite well with the sophisticated and computationally intensive 5-Degree of Freedom simulation program.

The optimum trajectories and the associated optimum trajectory command data were found for various launch conditions and target scenarios.

The above missile launch conditions were combined with the corresponding optimum trajectory command data to produce input/target learning sets, and with this data the "nonadaptive" neural network of FIG. 1 was trained. In a relatively short period of time, this neural network learned the trends in the input/target data and was able to memorize and provide optimal trajectory commands with an appropriately small error.

Figure 7:
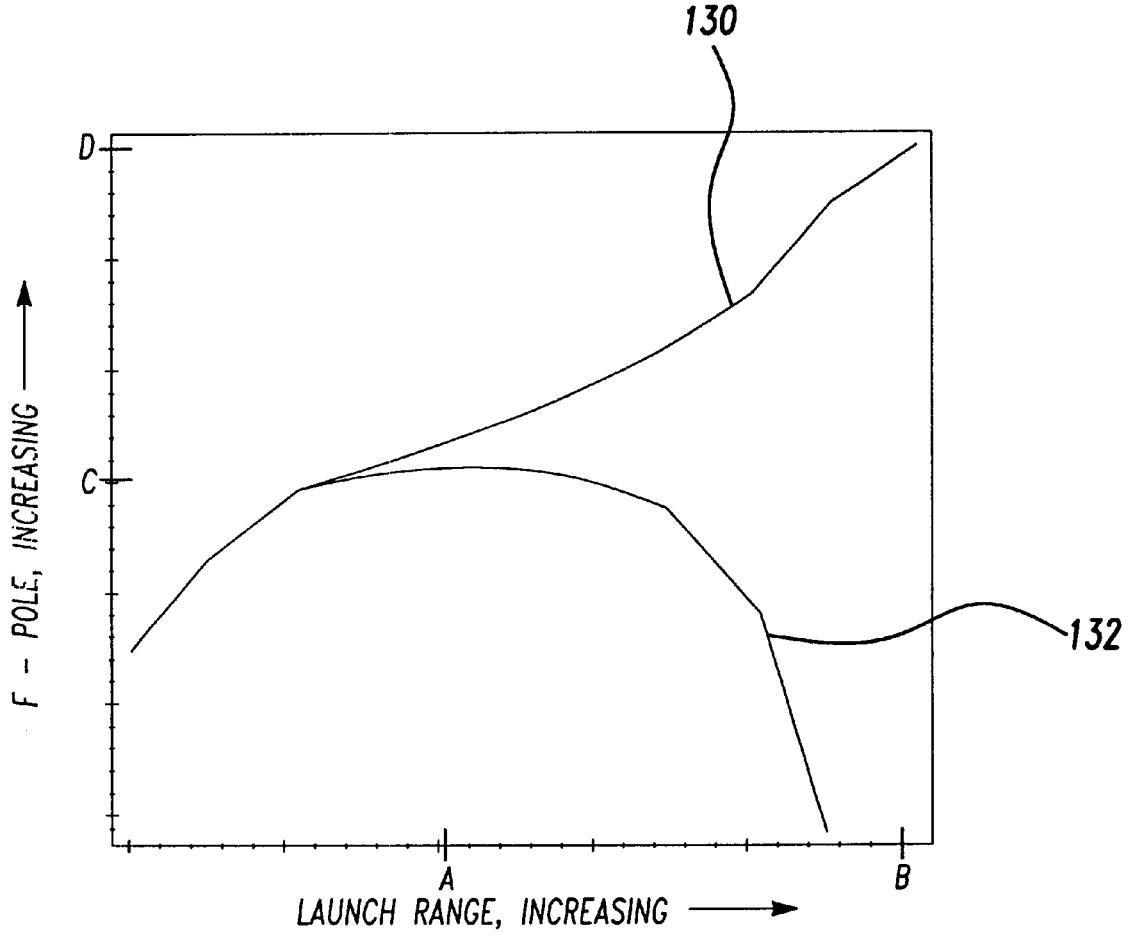
FIG. 7 is an x–y graph depicting the F-Pole versus launch range relationship for the present invention and for a conventional trajectory shaping approach.

FIG. 7 depicts the performance results 130 of a missile system using the "nonadaptive" neural network embodiment and the performance results 132 of the same missile system using a conventional trajectory shaping approach. The abscissa axis is missile launch range. The ordinate axis is an F-Pole figure of merit. F-Pole is defined as the distance between the launch aircraft and the target when the missile intercepts the target, given that the launch aircraft and target aircraft continue to fly straight and level and toward each other after missile launch. operationally, the F-Pole figure of merit indicates missile launch range and average velocity capabilities.

FIG. 7 shows that a missile controlled by the neural network of the present invention (i.e., results 130) is capable of longer launch ranges and higher average velocities and increased F-Poles over a conventionally trajectory shaped missile (as shown by results 132).

The missile system with conventional trajectory shaping has maximum performance when launched from a range of "A" and achieves a F-Pole of "C". With the neural network of the present invention, the missile launch range performance increased from "A" to "B" with a corresponding increase in F-Pole from "C" to "D". Additionally, missiles with the neural network of the present invention continues to increase in performance even for launch ranges beyond those plotted in FIG. 7.

It will be appreciated by those skilled in the art that various changes and modifications may be made to the embodiments discussed in the specification without departing from the spirit and scope of the invention as defined by the appended claims. For example, neural network control and optimization of guidance for torpedoes or other similar vehicles are also likely application areas for this invention.

What is claimed is:

1. A neural network apparatus for controlling trajectory of an object to a non-final position, said object having a final position, wherein a guidance system independent of said neural network guides the object from said non-final position to said final position, comprising:

an input layer having nodes for receiving input data indicative of the final position;

first weighted connections connected to said nodes of said input layer, each of said first weighted connections having a coefficient for weighting said input data; and an output layer having nodes connected to said first weighted connections, said output layer nodes determining trajectory data based upon said first weighted input data, said trajectory of the object to the non-final position being controlled based upon said determined trajectory data, wherein path of the object is subsequently controlled from the non-final position to the final position by said guidance system independent of said neural network;

a hidden layer having nodes connected to said first weighted connections, said hidden layer being interposed between said input and output layers;

second weighted connections connected to said hidden layer nodes and to said output layer nodes, each of said second weighted connections having a coefficient for weighting said outputs of said hidden layer nodes;

said path of the object from the non-final position to the final position being controlled by a guidance system independent of said apparatus, said guidance system independent of said apparatus acquiring control of the path of the object from the apparatus in order to guide the object from the non-final position to the final position; and said input to said output layer nodes from said hidden layer nodes is based upon a non-linear squashing function.

2. A neural network apparatus for controlling trajectory of an object to a non-final position, said object having a final position, wherein a guidance system independent of said neural network guides the object from said non-final position to said final position, comprising:

an input layer having nodes for receiving input data indicative of the final position, said input data including launch cue data;

first weighted connections connected to said nodes of said input layer, each of said first weighted connections having a coefficient for weighting said input data; and an output layer having nodes connected to said first weighted connections, said output layer nodes determining trajectory data based upon said first weighted input data, said trajectory of the object to the non-final position being controlled based upon said determined trajectory data, wherein path of the object is subsequently controlled from the non-final position to the final position by said guidance system independent of said neural network.

3. A neural network apparatus for controlling trajectory of an object to a non-final position, said object having a final position, wherein a guidance system independent of said neural network guides the object from said non-final position to said final position, comprising:

an input layer having nodes for receiving input data indicative of the final position;

first weighted connections connected to said nodes of said input layer, each of said first weighted connections having a coefficient for weighting said input data; and an output layer having nodes connected to said first weighted connections, said output layer nodes determining trajectory data based upon said first weighted input data, said determined trajectory data including azimuth and elevation flight control data, said trajectory of the object to the non-final position being controlled based upon said determined trajectory data, wherein path of the object is subsequently controlled from the non-final position to the final position by said guidance system independent of said neural network.

4. A neural network apparatus for controlling trajectory of an object to a non-final position, said object having a final position, wherein a guidance system independent of said neural network guides the object from said non-final position to said final position, comprising:

an input layer having nodes for receiving input data indicative of the final position;

first weighted connections connected to said nodes of said input layer, each of said first weighted connections having a coefficient for weighting said input data; and an output layer having nodes connected to said first weighted connections, said output layer nodes determining when control is to be transferred to said guidance system independent of said neural network based upon the object being a distance away from the final position that satisfies a predetermined threshold, said output layer nodes determining trajectory data based upon said first weighted input data, said trajectory of the object to the non-final position being controlled based upon said determined trajectory data, wherein path of the object is subsequently controlled from the non-final position to the final position by said guidance system independent of said neural network.

5. A neural network apparatus for controlling trajectory of an object to a non-final position, said object having a final position, wherein a guidance system independent of said neural network guides the object from said non-final position to said final position, comprising:

an input layer having nodes for receiving input data indicative of the final position;

first weighted connections connected to said nodes of said input layer, each of said first weighted connections having a coefficient for weighting said input data; and an output layer having nodes connected to said first weighted connections, said output layer nodes determining when radar of the object is to be activated based upon said input data, said output layer nodes determining trajectory data based upon said first weighted input data, said trajectory of the object to the non-final position being controlled based upon said determined trajectory data, wherein path of the object is subsequently controlled from the non-final position to the final position by said guidance system independent of said neural network.

6. A neural network apparatus for controlling trajectory of an object to a non-final position, said object having a final position, wherein a guidance system independent of said neural network guides the object from said non-final position to said final position, comprising:

an input layer having nodes for receiving input data indicative of the final-position;

first weighted connections connected to said nodes of said input layer, each of said first weighted connections having a coefficient for weighting said input data; and an output layer having nodes connected to said first weighted connections, said output layer nodes determining when weaponry of the object is to be activated based upon the object being a distance away from the final position that satisfies a predetermined threshold, said output layer nodes determining trajectory data based upon said first weighted input data, said trajectory of the object to the non-final position being controlled based upon said determined trajectory data, wherein path of the object is subsequently controlled from the non-final position to the final position by said guidance system independent of said neural network.

7. A method for controlling trajectory of an object to a non-final position with a neural network, said object being directed to a final position by a second controller that is independent of said neural network, comprising the steps:

receiving input data at nodes of an input layer of said neural network, each of said input layer nodes being associated to nodes of a subsequent layer via first weighting coefficients;

determining trajectory data based upon said weighting coefficients and said input data, said trajectory of the object to the non-final position being controlled based upon said determined trajectory data;

controlling path of the object from the non-final position to the final position by said controller being independent of said neural network;

determining intermediate outputs as a function of their inputs at a plurality of layers which are subsequent to said input layer, said intermediate outputs of at least one of said subsequent layers being based upon a non-linear squashing function; and determining said trajectory data based upon said intermediate outputs.

8. A method for controlling trajectory of an object to a non-final position with a neural network, said object being directed to a final position by a second controller that is independent of said neural network, comprising the steps: receiving input data at nodes of an input layer of said neural network, each of said input layer nodes being associated to nodes of a subsequent layer via first weighting coefficients;

determining trajectory data based upon said weighting coefficients and said input data, said trajectory of the object to the non-final position being controlled based upon said determined trajectory data;

controlling path of the object from the non-final position to the final position by said controller being independent of said neural network; and determining when control is to be transferred to said second controller that is independent of said neural network being a distance away from the final position that satisfies a predetermined threshold.

9. A method for controlling trajectory of an object to a non-final position with a neural network, said object being directed to a final position by a second controller that is independent of said neural network, comprising the steps:

receiving input data at nodes of an input layer of said neural network, each of said input layer nodes being associated to nodes of a subsequent layer via first weighting coefficients;

determining trajectory data based upon said weighting coefficients and said input data, said trajectory of the object to the non-final position being controlled based upon said determined trajectory data;

controlling path of the object from the non-final position to the final position by said controller being independent of said neural network; and determining when radar of the object is to be activated based upon said input data.

10. A method for controlling trajectory of an object to a non-final position with a neural network, said object being directed to a final position by a second controller that is independent of said neural network, comprising the steps:

receiving input data at nodes of an input layer of said neural network, each of said input layer nodes being associated to nodes of a subsequent layer via first weighting coefficients;

determining trajectory data based upon said weighting coefficients and said input data, said trajectory of the object to the non-final position being controlled based upon said determined trajectory data;

controlling path of the object from the non-final position to the final position by said controller being independent of said neural network; and determining when weaponry of the object is to be activated based upon the object being a distance away from the final position that satisfies a predetermined threshold.

* * * * *